US010018075B2

(12) United States Patent
Heitman et al.

(10) Patent No.: US 10,018,075 B2
(45) Date of Patent: Jul. 10, 2018

(54) METHODS FOR POSITIONING NEIGHBORING NOZZLES OF A GAS TURBINE ENGINE

(71) Applicant: General Electric Company, Schenectady, NY (US)

(72) Inventors: Bryce Loring Heitman, Cincinnati, OH (US); Steven James Murphy, Cincinnati, OH (US); Darrell Glenn Senile, Oxford, OH (US)

(73) Assignee: General Electric Company, Schenectady, NY (US)

( * ) Notice: Subject to any disclaimer, the term of this patent is extended or adjusted under 35 U.S.C. 154(b) by 509 days.

(21) Appl. No.: 14/692,818

(22) Filed: Apr. 22, 2015

(65) Prior Publication Data

US 2016/0312658 A1 Oct. 27, 2016

(51) Int. Cl.

| | |
|---|---|
| ***F04D 29/44*** | (2006.01) |
| ***F01D 25/28*** | (2006.01) |
| ***F01D 9/04*** | (2006.01) |

(52) U.S. Cl.

CPC ..... *F01D 25/28* (2013.01); *F01D 9/041* (2013.01); *F01D 9/047* (2013.01); *F05D 2220/32* (2013.01); *F05D 2230/23* (2013.01); *F05D 2230/237* (2013.01); *F05D 2230/60* (2013.01); *F05D 2240/128* (2013.01);

(Continued)

(58) Field of Classification Search

None

See application file for complete search history.

(56) References Cited

U.S. PATENT DOCUMENTS

| | | | | |
|---|---|---|---|---|
| 4,080,102 A * | 3/1978 | Schwab | ..... | F01D 5/141 416/223 A |
| 4,688,992 A | 8/1987 | Kirkpatrick et al. | | |
| 4,720,236 A | 1/1988 | Stevens | | |

(Continued)

FOREIGN PATENT DOCUMENTS

| | | |
|---|---|---|
| EP | 1607581 A1 | 12/2005 |
| EP | 1731716 A2 | 12/2006 |

(Continued)

OTHER PUBLICATIONS

European Search Report and opinion issued in connection with corresponding EP Application No. 16165429.8 dated Nov. 9, 2016.

(Continued)

*Primary Examiner* — Logan Kraft
*Assistant Examiner* — Jason Fountain
(74) *Attorney, Agent, or Firm* — General Electric Company; William Andes

(57) ABSTRACT

Methods for positioning neighboring nozzles of a gas turbine engine are provided. A method includes assembling a first nozzle assembly. The first nozzle assembly includes a first nozzle and a first nozzle support structure. The method further includes assembling a second nozzle assembly. The second nozzle assembly includes a second nozzle and a second nozzle support structure. The method further includes adjusting the first nozzle assembly and the second nozzle assembly such that an engineering dimension between the first nozzle and the second nozzle is within a predetermined engineering tolerance, and joining the first nozzle support structure and the second nozzle support structure together.

9 Claims, 8 Drawing Sheets

(52) U.S. Cl.
CPC ..... *F05D 2240/80* (2013.01); *F05D 2300/10* (2013.01); *F05D 2300/6033* (2013.01)

(56) References Cited

U.S. PATENT DOCUMENTS

| | | | | |
|---|---|---|---|---|
| 4,815,933 | A | 3/1989 | Hansel et al. | |
| 5,332,360 | A | 7/1994 | Correia et al. | |
| 5,931,636 | A * | 8/1999 | Savage | F01D 17/141 415/115 |
| 7,093,359 | B2 * | 8/2006 | Morrison | F01D 5/282 264/257 |
| 8,007,229 | B2 * | 8/2011 | McCaffrey | F01D 9/041 29/889.22 |
| 8,636,466 | B2 | 1/2014 | Cortequisse | |
| 8,834,109 | B2 | 9/2014 | Propheter-Hinckley | |
| 8,998,577 | B2 * | 4/2015 | Gustafson | F01D 5/142 415/198.1 |
| 2003/0133790 | A1 | 7/2003 | Darkins, Jr. et al. | |
| 2007/0084052 | A1 | 4/2007 | Heinrich et al. | |
| 2013/0034434 | A1 | 2/2013 | Propheter-Hinckley | |
| 2014/0314556 | A1 | 10/2014 | Fremont et al. | |

FOREIGN PATENT DOCUMENTS

| | | | |
|---|---|---|---|
| EP | 1767895 | A1 | 3/2007 |
| EP | 2113636 | A2 | 11/2009 |
| JP | H04-11723 | B2 | 3/1992 |
| JP | H05-195706 | A | 8/1993 |
| JP | 2617707 | B2 | 6/1997 |
| JP | H11-93609 | A | 4/1999 |
| JP | H11-107704 | A | 4/1999 |
| JP | H11-125102 | A | 5/1999 |
| JP | 2003-501581 | A | 1/2003 |
| JP | 4183996 | B2 | 11/2008 |
| JP | 4733306 | B2 | 7/2011 |

OTHER PUBLICATIONS

Notification of Reasons for Refusal issued in connection with corresponding JP Application No. 2016-082608 dated May 9, 2017.

* cited by examiner

METHODS FOR POSITIONING NEIGHBORING NOZZLES OF A GAS TURBINE ENGINE

FIELD OF THE INVENTION

The present subject matter relates generally to nozzles of gas turbine engines, and more particularly to methods for positioning neighboring nozzles of gas turbine engines such that particular engineering dimensions between the nozzles are within predetermined tolerances.

BACKGROUND OF THE INVENTION

A gas turbine engine generally includes, in serial flow order, a compressor section, a combustion section, a turbine section and an exhaust section. In operation, air enters an inlet of the compressor section where one or more axial compressors progressively compress the air until it reaches the combustion section. Fuel is mixed with the compressed air and burned within the combustion section to provide combustion gases. The combustion gases are routed from the combustion section through a hot gas path defined within the turbine section and then exhausted from the turbine section via the exhaust section.

In particular configurations, the turbine section includes, in serial flow order, a high pressure (HP) turbine and a low pressure (LP) turbine. The HP turbine and the LP turbine each include various rotatable turbine components such as turbine rotor blades, rotor disks and retainers, and various stationary turbine components such as stator vanes or nozzles, turbine shrouds and engine frames. The rotatable and the stationary turbine components at least partially define the hot gas path through the turbine section. As the combustion gases flow through the hot gas path, thermal energy is transferred from the combustion gases to the rotatable turbine components and the stationary turbine components.

Nozzles utilized in gas turbine engines, and in particular HP turbine nozzles, are often arranged as an array of airfoil-shaped vanes extending between annular inner and outer bands which define the primary flowpath through the nozzles. Further, the spacing between and orientation of the components of neighboring nozzles arranged in an annular array is of particular concern for optimal gas turbine engine performance. Various engineering dimensions between features of neighboring nozzles, and in particular the airfoils thereof, are measured and evaluated. It is generally desirable that these engineering dimensions are within desired predetermined tolerances for optimal gas turbine engine performance. One engineering dimension that is of particular concern is the dimension between a trailing edge of an airfoil of a nozzle and a high camber location on a suction side of an airfoil of a neighboring nozzle. This engineering dimension is sometimes termed the "A41" dimension. If this dimension is smaller than a predetermined optimal range of dimensions, the gas turbine engine compressor can stall. If this dimension is larger than the predetermined optimal range of dimensions, the efficiency of the gas turbine engine can be lowered.

Accordingly, improved methods for positioning neighboring nozzles are desired. In particular, methods which provide for positioning such that particular engineering dimensions between the neighboring nozzles are within predetermined tolerances would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a method for positioning neighboring nozzles of a gas turbine engine is provided. The method includes assembling a first nozzle assembly. The first nozzle assembly includes a first nozzle and a first nozzle support structure. The first nozzle includes an airfoil, an outer band disposed radially outward of the airfoil, and an inner band disposed radially inward of the airfoil. The first nozzle support structure includes a strut extending through the nozzle, an outer hanger disposed radially outward of the airfoil, and an inner hanger disposed radially inward of the airfoil. The method further includes assembling a second nozzle assembly. The second nozzle assembly includes a second nozzle and a second nozzle support structure. The second nozzle includes an airfoil, an outer band disposed radially outward of the airfoil, and an inner band disposed radially inward of the airfoil. The second nozzle support structure included a strut extending through the nozzle, an outer hanger disposed radially outward of the airfoil, and an inner hanger disposed radially inward of the airfoil. The method further includes adjusting the first nozzle assembly and the second nozzle assembly such that an engineering dimension between the first nozzle and the second nozzle is within a predetermined engineering tolerance, and joining the first nozzle support structure and the second nozzle support structure together.

In accordance with another embodiment of the present disclosure, a method for positioning neighboring nozzles of a gas turbine engine is provided. The method includes assembling a first nozzle assembly. The first nozzle assembly includes a first nozzle and a first nozzle support structure. The first nozzle includes an airfoil, an outer band disposed radially outward of the airfoil, and an inner band disposed radially inward of the airfoil. The first nozzle support structure includes a strut extending through the nozzle, an outer hanger disposed radially outward of the airfoil, and an inner hanger disposed radially inward of the airfoil. The method further includes assembling a second nozzle assembly. The second nozzle assembly includes a second nozzle and a second nozzle support structure. The second nozzle includes an airfoil, an outer band disposed radially outward of the airfoil, and an inner band disposed radially inward of the airfoil. The second nozzle support structure included a strut extending through the nozzle, an outer hanger disposed radially outward of the airfoil, and an inner hanger disposed radially inward of the airfoil. The method further includes, after assembling the first nozzle assembly and the second nozzle assembly, adjusting the first nozzle assembly and the second nozzle assembly such that an engineering dimension between the first nozzle and the second nozzle is within a predetermined engineering tolerance. The method further includes, after adjusting the first nozzle assembly and the second nozzle assembly, joining the first nozzle support structure and the second nozzle support structure together.

In accordance with another embodiment of the present disclosure, a method for positioning neighboring nozzles of a gas turbine engine is provided. The method includes joining an inner hanger of a first nozzle support structure and an inner hanger of a second nozzle support structure together, and joining an outer hanger of the first nozzle support structure and an outer hanger of the second nozzle support structure together. The method further includes, after joining the inner hangers and outer hangers together, assembling a first nozzle assembly. The first nozzle assembly includes a first nozzle and the first nozzle support structure. The first nozzle includes an airfoil, an outer band disposed radially outward of the airfoil, and an inner band disposed radially inward of the airfoil. The first nozzle support structure includes a strut extending through the nozzle, the outer hanger disposed radially outward of the airfoil, and the inner hanger disposed radially inward of the airfoil. The method further includes, after joining the inner hangers and outer hangers together, assembling a second nozzle assembly. The second nozzle assembly includes a second nozzle and the second nozzle support structure. The second nozzle includes an airfoil, an outer band disposed radially outward of the airfoil, and an inner band disposed radially inward of the airfoil. The second nozzle support structure included a strut extending through the nozzle, the outer hanger disposed radially outward of the airfoil, and the inner hanger disposed radially inward of the airfoil. The method further includes adjusting the first nozzle assembly and the second nozzle assembly such that an engineering dimension between the first nozzle and the second nozzle is within a predetermined engineering tolerance.

In accordance with another embodiment of the present disclosure, a nozzle doublet assembly for a gas turbine engine is provided. The nozzle doublet assembly includes a first nozzle assembly. The first nozzle assembly includes a nozzle and a nozzle support structure, the nozzle including an airfoil having an exterior surface defining a pressure side and a suction side extending between a leading edge and a trailing edge, an outer band disposed radially outward of the airfoil, and an inner band disposed radially inward of the airfoil, the nozzle support structure including a strut extending through the airfoil, the outer band of the nozzle and the inner band of the nozzle, an outer hanger disposed radially outward of the airfoil, and an inner hanger disposed radially inward of the airfoil. The nozzle doublet assembly further includes a second nozzle assembly. The second nozzle assembly includes a nozzle and a nozzle support structure, the nozzle including an airfoil having an exterior surface defining a pressure side and a suction side extending between a leading edge and a trailing edge, an outer band disposed radially outward of the airfoil, and an inner band disposed radially inward of the airfoil, the nozzle support structure including a strut extending through the airfoil, the outer band of the nozzle and the inner band of the nozzle, an outer hanger disposed radially outward of the airfoil, and an inner hanger disposed radially inward of the airfoil. The inner hangers of the first nozzle assembly and the second nozzle assembly are joined together and the outer hangers of the first nozzle assembly and the second nozzle assembly are joined together.

In some embodiments, the strut of the first nozzle assembly is joined to at least one of the inner hanger or the outer hanger of the first nozzle assembly and the strut of the second nozzle assembly is joined to at least one of the inner hanger or the outer hanger of the second nozzle assembly. In some embodiments, the strut of the first nozzle assembly is connected to at least one of the inner hanger or the outer hanger of the first nozzle assembly and the strut of the second nozzle assembly is connected to at least one of the inner hanger or the outer hanger of the second nozzle assembly.

In some embodiments, an engineering dimension between the nozzle of the first nozzle assembly and the nozzle of the second nozzle assembly is within a predetermined engineering tolerance. For example, the predetermined engineering tolerance may be plus or minus 4%, plus or minus 3%, plus or minus 2%, etc.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
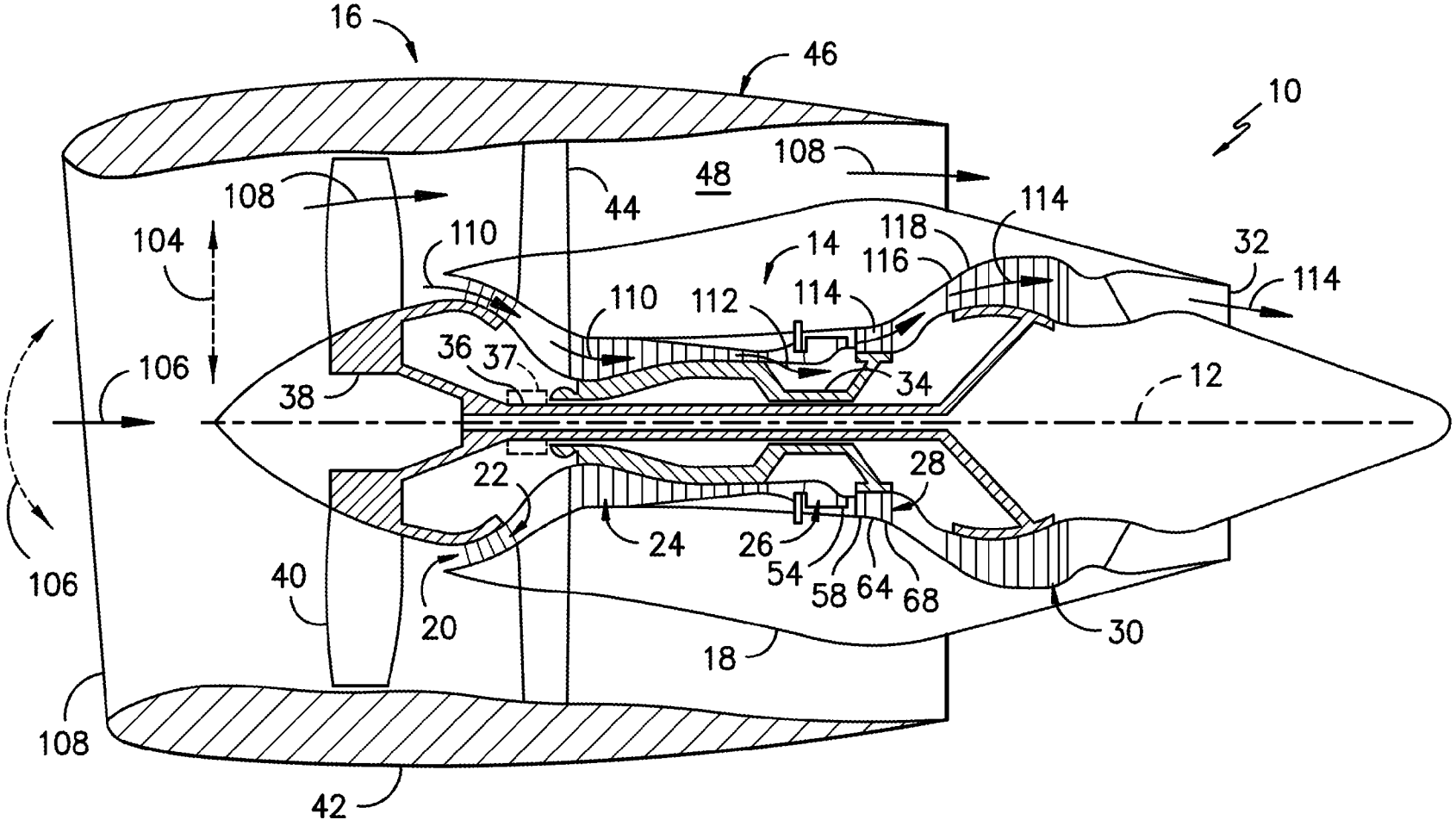
FIG. 1 is a schematic cross-sectional view of a gas turbine engine in accordance with one embodiment of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Further, as used herein, the terms "axial" or "axially" refer to a dimension along a longitudinal axis of an engine. The term "forward" used in conjunction with "axial" or "axially" refers to a direction toward the engine inlet, or a component being relatively closer to the engine inlet as compared to another component. The term "rear" used in conjunction with "axial" or "axially" refers to a direction toward the engine nozzle, or a component being relatively closer to the engine nozzle as compared to another component. The terms "radial" or "radially" refer to a dimension extending between a center longitudinal axis of the engine and an outer engine circumference.

Referring now to the drawings, FIG. 1 is a schematic cross-sectional view of an exemplary high-bypass turbofan type engine 10 herein referred to as "turbofan 10" as may incorporate various embodiments of the present disclosure. As shown in FIG. 1, the turbofan 10 has a longitudinal or axial centerline axis 12 that extends therethrough for reference purposes. In general, the turbofan 10 may include a core turbine or gas turbine engine 14 disposed downstream from a fan section 16.

The gas turbine engine 14 may generally include a substantially tubular outer casing 18 that defines an annular inlet 20. The outer casing 18 may be formed from multiple casings. The outer casing 18 encases, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The (LP) spool 36 may also be connected to a fan spool or shaft 38 of the fan section 16. In particular embodiments, the (LP) spool 36 may be connected directly to the fan spool 38 such as in a direct-drive configuration. In alternative configurations, the (LP) spool 36 may be connected to the fan spool 38 via a speed reduction device 37 such as a reduction gear gearbox in an indirect-drive or geared-drive configuration. Such speed reduction devices may be included between any suitable shafts/spools within engine 10 as desired or required.

As shown in FIG. 1, the fan section 16 includes a plurality of fan blades 40 that are coupled to and that extend radially outwardly from the fan spool 38. An annular fan casing or nacelle 42 circumferentially surrounds the fan section 16 and/or at least a portion of the gas turbine engine 14. It should be appreciated by those of ordinary skill in the art that the nacelle 42 may be configured to be supported relative to the gas turbine engine 14 by a plurality of circumferentially-spaced outlet guide vanes 44. Moreover, a downstream section 46 of the nacelle 42 (downstream of the guide vanes 44) may extend over an outer portion of the gas turbine engine 14 so as to define a bypass airflow passage 48 therebetween.

Figure 2:
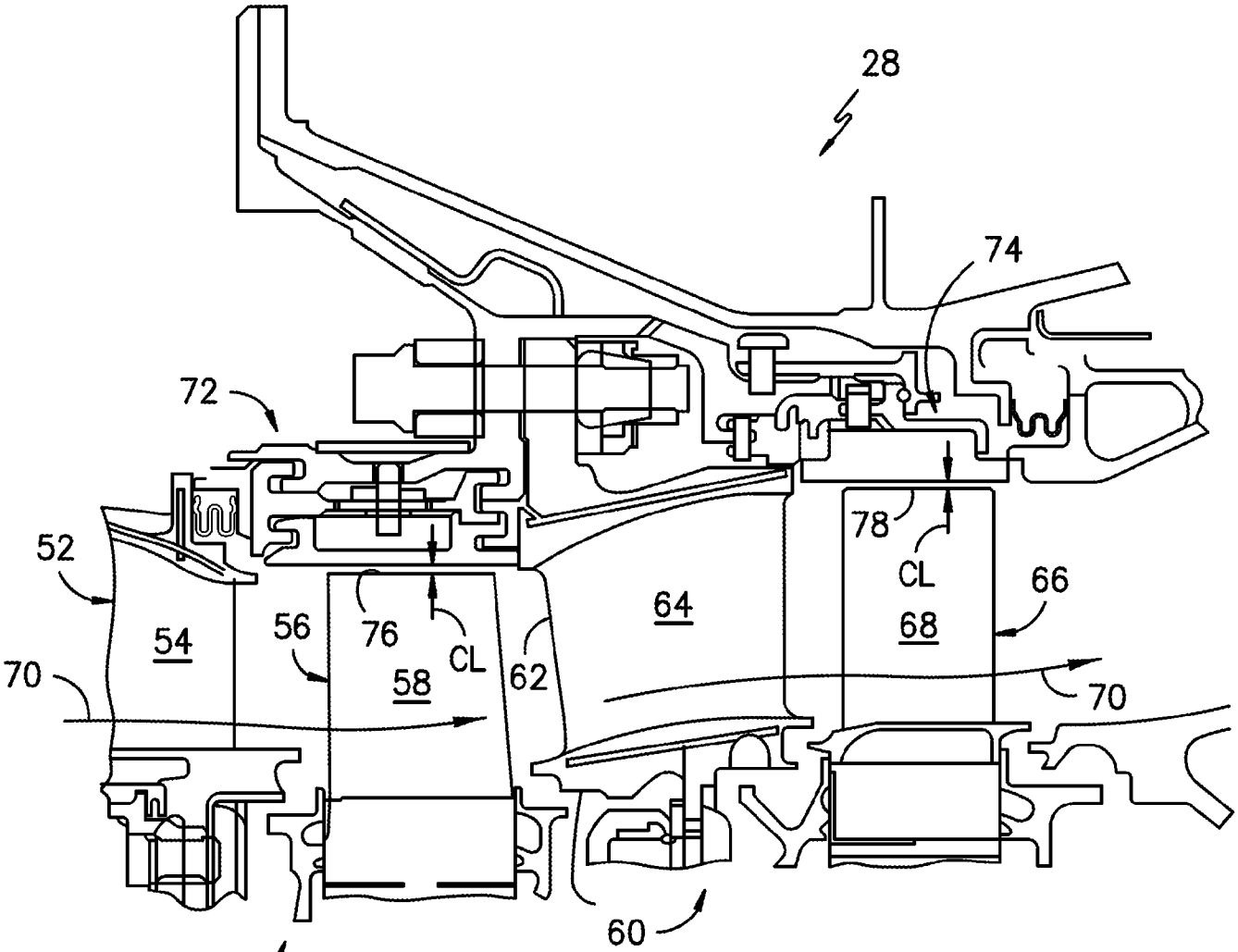
FIG. 2 is an enlarged circumferential cross sectional side view of a high pressure turbine portion of a gas turbine engine in accordance with one embodiment of the present disclosure.

FIG. 2 provides an enlarged cross sectioned view of the HP turbine 28 portion of the gas turbine engine 14 as shown in FIG. 1, as may incorporate various embodiments of the present invention. As shown in FIG. 2, the HP turbine 28 includes, in serial flow relationship, a first stage 50 which includes an annular array 52 of stator vanes (also known as nozzles) 54 (only one shown) axially spaced from an annular array 56 of turbine rotor blades 58 (only one shown). The HP turbine 28 further includes a second stage 60 which includes an annular array 62 of stator vanes (also known as nozzles) 64 (only one shown) axially spaced from an annular array 66 of turbine rotor blades 68 (only one shown). The turbine rotor blades 58, 68 extend radially outwardly from and are coupled to the HP spool 34 (FIG. 1). As shown in FIG. 2, the stator vanes 54, 64 and the turbine rotor blades 58, 68 at least partially define a hot gas path 70 for routing combustion gases from the combustion section 26 (FIG. 1) through the HP turbine 28.

As further shown in FIG. 2, the HP turbine may include one or more shroud assemblies, each of which forms an annular ring about an annular array of rotor blades. For example, a shroud assembly 72 may form an annular ring around the annular array 56 of rotor blades 58 of the first stage 50, and a shroud assembly 74 may form an annular ring around the annular array 66 of turbine rotor blades 68 of the second stage 60. In general, shrouds of the shroud assemblies 72, 74 are radially spaced from blade tips 76, 78 of each of the rotor blades 68. A radial or clearance gap CL is defined between the blade tips 76, 78 and the shrouds. The shrouds and shroud assemblies generally reduce leakage from the hot gas path 70.

It should be noted that shrouds and shroud assemblies may additionally be utilized in a similar manner in the low pressure compressor 22, high pressure compressor 24, and/or low pressure turbine 30. Accordingly, shrouds and shrouds assemblies as disclosed herein are not limited to use in HP turbines, and rather may be utilized in any suitable section of a gas turbine engine.

As discussed, the spacing and orientation of nozzles in an engine 10 is of particular concern. Accordingly, and referring now to FIGS. 3 through 9, the present disclosure is further directed to methods for positioning neighboring nozzles 102 of a gas turbine engine 10. The neighboring nozzles 102 in accordance with the present disclosure are nozzles which are or will be next to one another in an annular array in engine 10. Nozzles 102 as disclosed herein may be utilized in place of stator vanes 54, stator vanes 64, or any other suitable stationary airfoil-based assemblies in an engine.

Figure 3:
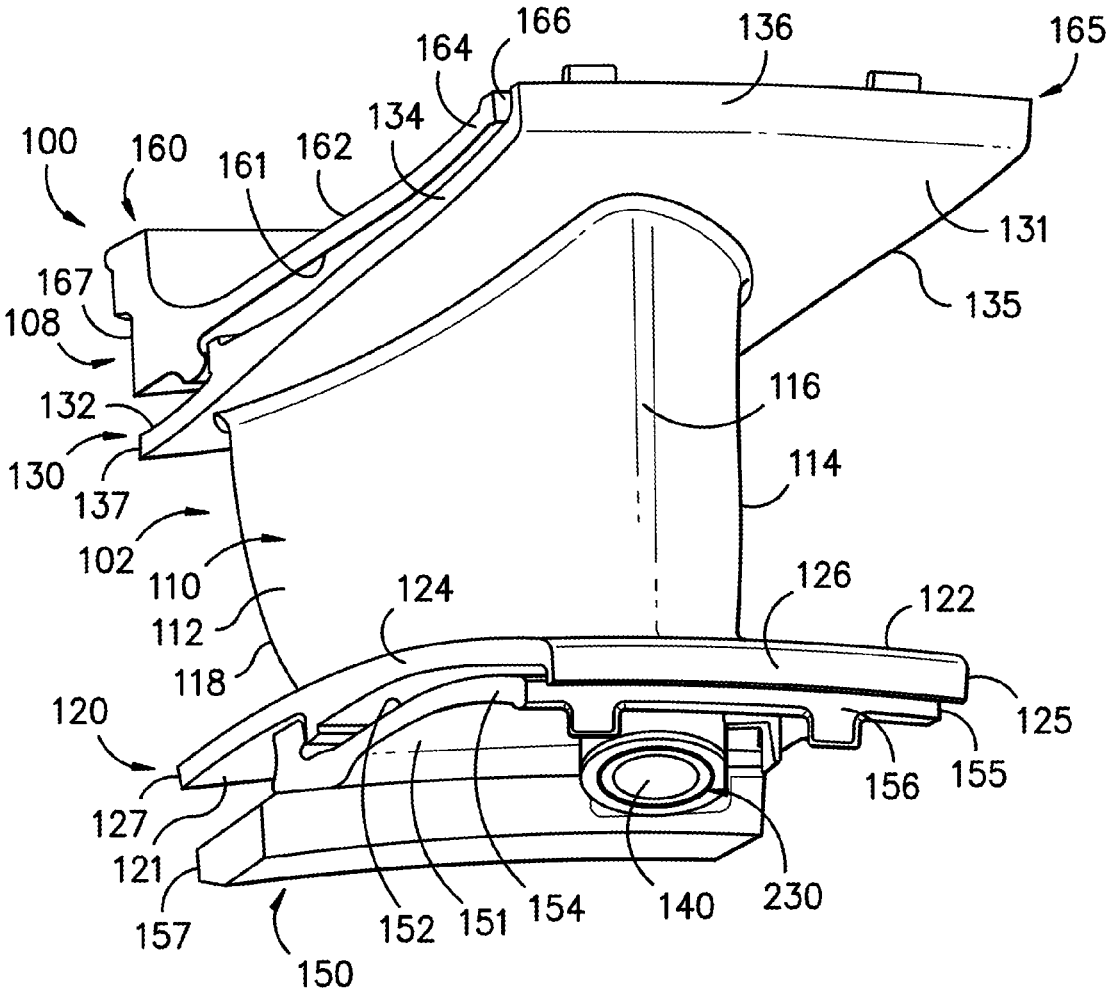
FIG. 3 is a perspective view of an assembled nozzle assembly in accordance with one embodiment of the present disclosure.

As shown for example in FIG. 3, a nozzle 102 in accordance with the present disclosure includes an airfoil 110, which has outer surfaces defining a pressure side 112, a suction side 114, a leading edge 116 and a trailing edge 118. The pressure side 112 and suction side 114 extend between the leading edge 116 and the trailing edge 118, as is generally understood. In typical embodiments, airfoil 110 is generally hollow, thus allowing cooling fluids to be flowed therethrough and structural reinforcement components to be disposed therein.

Nozzle 102 can further include an inner band 120 and an outer band 130, each of which is connected to the airfoil 110 at radially outer ends thereof generally along a radial direction 104. Adjacent nozzles 102 in an array of nozzles 102 may be situated side by side along a circumferential direction 106, as shown, with neighboring surfaces of the inner bands 120 in contact and neighboring surfaces of the outer bands 130 in contact. Inner band 120 may be disposed radially inward of the airfoil 110, while outer band 130 may be disposed radially outward of the airfoil 110. Inner band 120 may include, for example, a radially inwardly-facing end surface 121 and a radially outwardly-facing end surface 122 which are spaced apart radially from each other. Inner band 120 may further include various side surfaces, including a pressure side slash face 124, suction side slash face 125, leading edge face 126 and trailing edge face 127. Similarly, outer band 130 may include, for example, a radially inwardly-facing end surface 131 and a radially outwardly-facing end surface 132 which are spaced apart radially from each other. Outer band 130 may further include various side surfaces, including a pressure side slash face 134, suction side slash face 135, leading edge face 136 and trailing edge face 137.

In exemplary embodiments, the airfoil 110, inner band 110 and outer band 120 may be formed from ceramic matrix composite ("CMC") materials. Alternatively, however, other suitable materials, such as suitable plastics, composites, metals, etc., may be utilized.

As further illustrated in FIG. 3, nozzle 102 may be a component of a nozzle assembly 100, which may additionally include a nozzle support structure 108. Each support structure 108 may be coupled to a nozzle 102 to support the nozzle 102 in engine 10. Further support structure 108 may transmit loads from the nozzle 102 to various other components within the engine 10.

Support structure 108 may include, for example, a strut 140. Strut 140 may generally extend through the airfoil 110, such as generally radially through the interior of the airfoil 110. Strut 140 may further extend through the inner band 120 and the outer band 130, such as through bore holes (not labeled) therein. In general, strut 208 may carry loads between the radial ends of the nozzle 102 to other components of the support structure 108. The loads may be transferred through these components to other components of the engine 10, such as the engine casing, etc.

For example, support structure 108 may include an inner hanger 150 and an outer hanger 160, each of which is connected to strut 140 at radially outer ends thereof generally along radial direction 104. Adjacent support structures 108 in an array of support structures 108 may be situated side by side along circumferential direction 106, as shown, with neighboring surfaces of the inner hangers 150 in contact and neighboring surfaces of the outer hangers 150 in contact. Inner hanger 150 may be disposed radially inward of the strut 140, while outer hanger 160 may be disposed radially outward of the strut 140. Further, inner hanger 150 may be positioned generally radially inward of the airfoil 110 and inner band 120. Outer hanger 160 may be positioned generally radially outward of the airfoil 110 and outer band 130. Inner hanger 150 may include, for example, a radially inwardly-facing end surface 151 and a radially outwardly-facing end surface 152 which are spaced apart radially from each other. Inner hanger 150 may further include various side surfaces, including a pressure side slash face 154, suction side slash face 155, leading edge face 156 and trailing edge face 157. Similarly, outer hanger 160 may include, for example, a radially inwardly-facing end surface 161 and a radially outwardly-facing end surface 162 which are spaced apart radially from each other. Outer hanger 160 may further include various side surfaces, including a pressure side slash face 164, suction side slash face 165, leading edge face 166 and trailing edge face 167.

In exemplary embodiments, the strut 140, inner hanger 150 and outer hanger 160 are formed from metals. Alternatively, however, other suitable materials, such as suitable plastics, composites, etc., may be utilized.

As mentioned, the present disclosure is directed to methods for positioning neighboring nozzles 102, in general to form nozzle doublet assemblies. For purposes of the present disclosure, neighboring nozzles 102 will be referred to respectively as a first nozzle 210 and a second nozzle 212. Neighboring nozzle assemblies 100 will be referred to respectively as a first nozzle assembly 200 and a second nozzle assembly 202. Neighboring nozzles support structures 108 will be referred to respectively as a first nozzle support structure 220 and a second nozzle support structure 212. First nozzle assembly 200 includes first nozzle 210 and first nozzle support structure 220, and second nozzle assembly 202 includes second nozzle 212 and second nozzle support structure 222. It should be understood that first and second nozzle assemblies 200, 202, nozzles 210, 212, and nozzle support structures 220, 222 may be any two neighboring nozzle assemblies 100, nozzles 102, and nozzle support structures 108, respectively, within or to be utilized within an engine 10.

Referring now to FIGS. 3 through 9, methods in accordance with the present disclosure may include, for example, assembling a first nozzle assembly 200 and a second nozzle assembly 202. FIG. 3 illustrates one embodiment of a nozzle assembly, which may be a first nozzle assembly 200 or a second nozzle assembly 202, which has been assembled in accordance with the present disclosure. In the embodiment of FIG. 3, the steps of assembling the first and second nozzle assemblies 200, 202 are performed before other steps of the present method, including an adjusting step and a joining step as discussed herein.

An assembled first or second nozzle assembly 200, 202 includes a nozzle 210, 212 and a nozzle support structure 220, 222. The strut 140 of the nozzle support structure 220, 222 generally extends through the nozzle 210, 212, such as through the airfoil 110, inner band 120 and outer band 130 thereof. In exemplary embodiments, the step of assembling a first nozzle assembly 200 and/or second nozzle assembly 202 includes, for example, the step of inserting the strut 140 of the first or second nozzle support structure 220, 222 through the first or second nozzle 210, 222, such as through the airfoil 110, inner band 120 and outer band 130 thereof. The step of assembling the first nozzle assembly 200 and/or second nozzle assembly 202 may further include, for example, the step of joining the strut 140 of the first or second nozzle support structure 220, 222 to one or both of the inner hanger 150 or outer hanger 160 of the first or second nozzle support structure 220, 222. In some embodiments, the strut 140 may be integral with one of the inner hanger 150 or outer hanger 160, and thus not require joining to this hanger. In other embodiments, the strut 140 may require joining to both hangers 150, 160. For example, in the embodiment of FIG. 3, the strut 140 is integral with the outer hanger 160 and joined to inner hanger 150.

Joining of components in accordance with the present disclosure may form a joint 230 between the components. In exemplary embodiments, joining is accomplished by brazing the components, such as the strut 140 and inner and/or outer hangers 150, 160, together. Alternatively, joining may be accomplished by welding or another suitable joining technique. Joining techniques in accordance with the present disclosure generally utilized a melted and then solidified filler material and/or melted and then solidified surfaces of the components to fix the subject components together.

Figure 6:
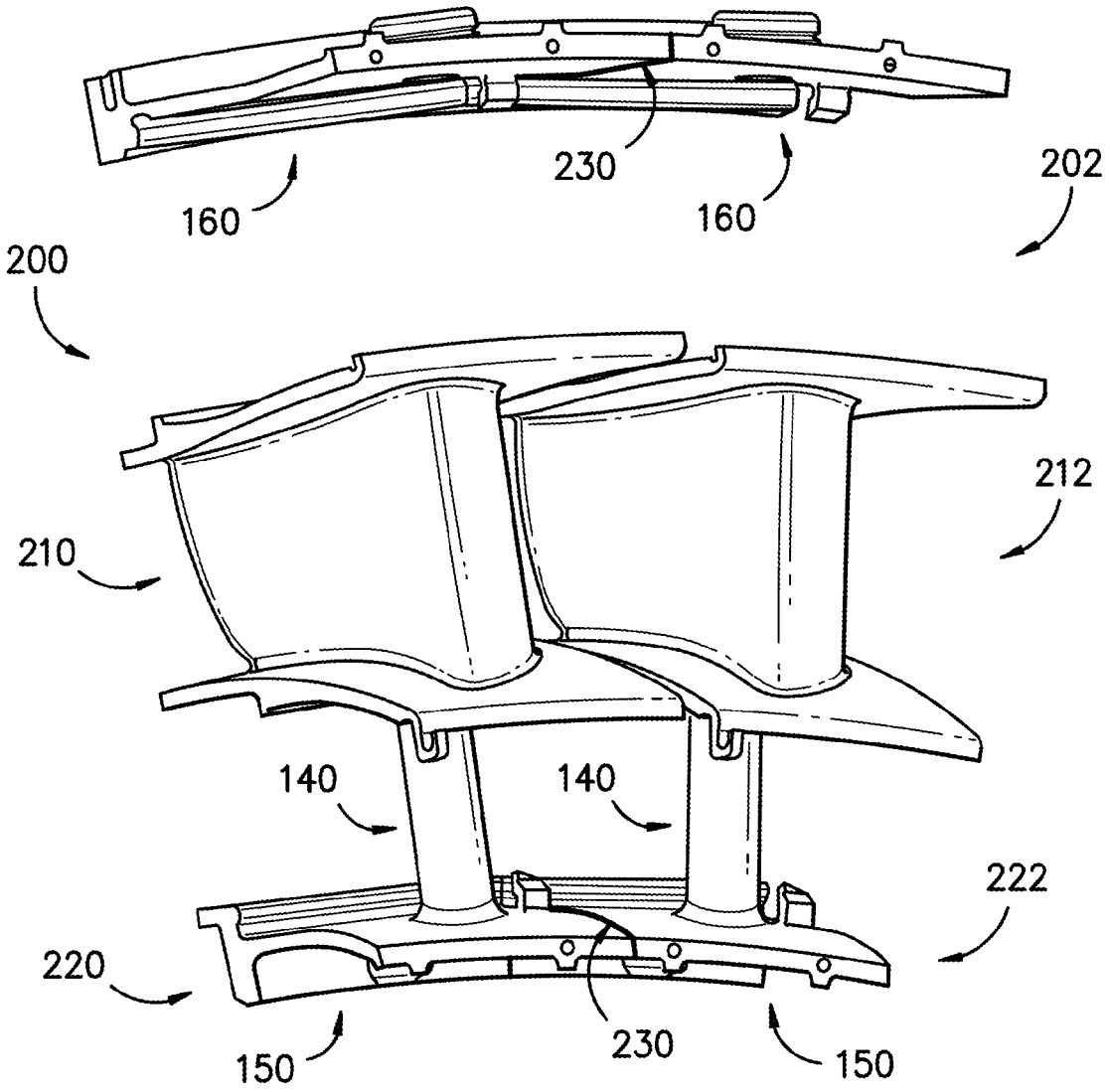
FIG. 6 is a perspective view of joined inner and outer hangers of neighboring nozzle support structures being assembled with neighboring nozzles to form neighboring nozzle assemblies in accordance with one embodiment of the present disclosure.

FIGS. 6 through 9 illustrate another embodiment of first and second nozzle assemblies 200, 202 being assembled in accordance with the present disclosure. In the embodiment of FIGS. 6 through 9, other steps of the method, such as joining steps as discussed herein, are performed before the steps of assembling the first and second nozzle assemblies 200, 202. FIG. 6 illustrates struts 140 of first and second nozzle support structures 150, 160 being inserted through respective first or second nozzles 210, 222, such as through the airfoils 110, inner bands 120 and outer bands 130 thereof. In these embodiments, however, rather than joining the strut 140 to the inner hanger 150 and/or outer hanger 160, the step of assembling the first nozzle assembly 200 and/or second nozzle assembly 202 may further include connecting the strut 140 to one or both of the inner hanger 150 or outer hanger 160. As discussed, in some embodiments, the strut 140 may be integral with one of the inner hanger 150 or outer hanger 160, and thus not require joining to this hanger. In other embodiments, the strut 140 may require connecting to both hangers 150, 160. For example, in the embodiments of FIG. 7 through, the strut 140 is integral with the inner hanger 150 and connected to outer hanger 160.

Figure 7:
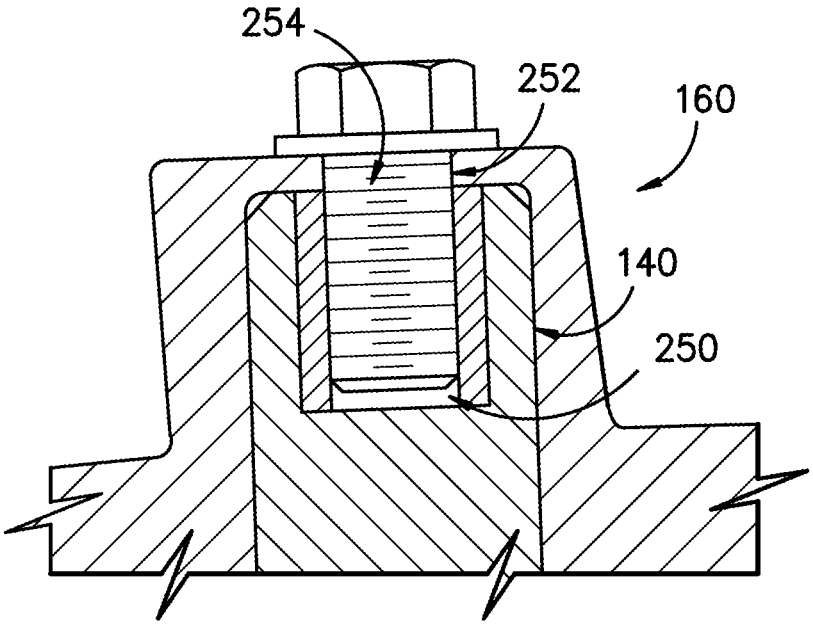
FIG. 7 is a cross-sectional view of apparatus for connecting components of a nozzle assembly in accordance with one embodiment of the present disclosure.
Figure 8:
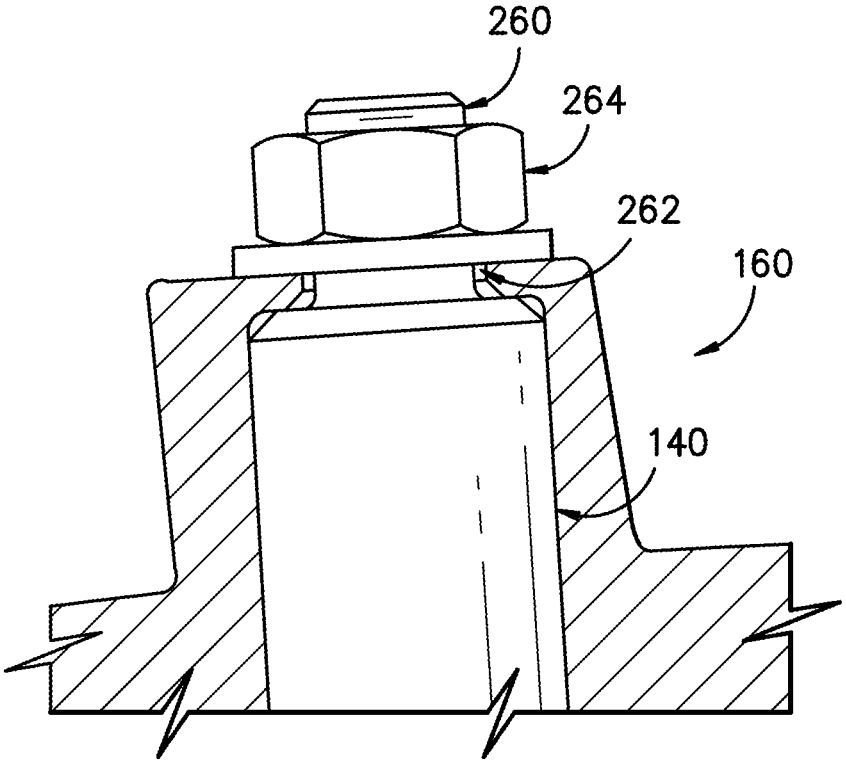
FIG. 8 is a cross-sectional view of apparatus for connecting components of a nozzle assembly in accordance with another embodiment of the present disclosure.
Figure 9:
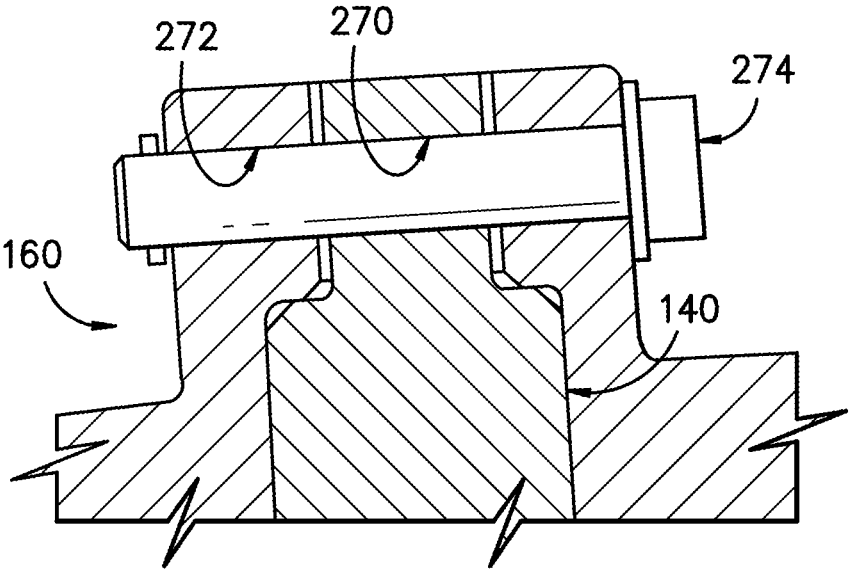
FIG. 9 is a cross-sectional view of apparatus for connecting components of a nozzle assembly in accordance with another embodiment of the present disclosure.

Connecting of components in accordance with the present disclosure may be accomplished via, for example, a suitable mechanical fastener or another suitable technique that generally results in a removable connection. For example, FIG. 7 illustrates one embodiment wherein the strut 140 defines a threaded inner bore 250 and the inner hanger 150 or outer hanger 160 defines a bore hole 252. A threaded bolt 254 may be extended through the bore hole 252, and outer threads of the bolt 254 may engage the inner threads of the threaded inner bore 250 to connect the strut 140 and the inner hanger 150 or outer hanger 160. FIG. 8 illustrates another embodiment wherein the strut 140 includes a threaded protrusion 260 (which may be integral with the strut 140) which extends through a bore hole 262 define in the inner hanger 150 or outer hanger 160. Inner threads of a threaded nut 264 may engage the outer threads of the threaded protrusion 260 to connect the strut 140 and the inner hanger 150 or outer hanger 160. FIG. 9 illustrates another embodiment wherein a bore hole 270 is defined in the strut 140 and a mating bore hole 272 is defined in the inner hanger 150 or outer hanger 160. A pin 274 may extend through the bore holes 270, 272 to connect the strut 140 and the inner hanger 150 or outer hanger 160.

A method in accordance with the present disclosure may further include, for example, the step of adjusting the first nozzle assembly 200 and second nozzle assembly 202 such that an engineering dimension between the first nozzle 210 and the second nozzle 212 is within a predetermined engineering tolerance. As discussed, the engineering dimension is in exemplary embodiments a dimension, such as an area, between a trailing edge 118 of the airfoil 110 of the first nozzle 210 and a high camber location on a suction side 114 of the airfoil 110 of the second nozzle 212. This dimension is labeled as reference number 240 in FIG. 4. Alternatively, however, an engineering dimension may be any suitable dimension, such as a length, width, height, area, etc., between the first nozzle 210 and the second nozzle 212 that is desired to be within a specified, predetermined tolerance for preferred engine 10 performance.

Use of methods in accordance with the present disclosure advantageously allows for the predetermined tolerances to be minimized, thus facilitate improved engine 10 performance as discussed herein. For example, in some embodiment, in particular wherein the engineering dimension is dimension 240, the predetermined tolerance may advantageously be plus or minus 4%, plus or minus 3%, plus or minus 2%, etc.

Figure 4:
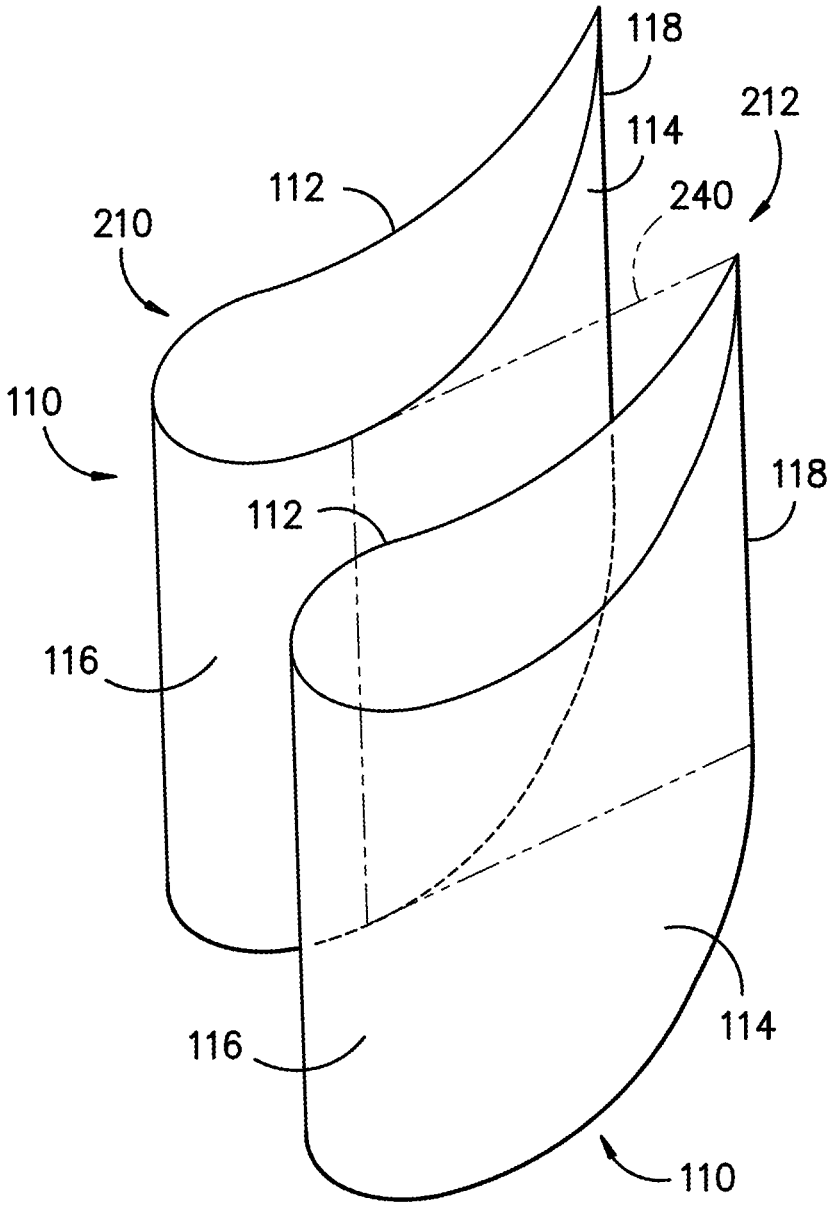
FIG. 4 is a perspective view of airfoils of neighboring nozzles illustrating the measurement of an engineering dimension in accordance with one embodiment of the present disclosure.

The adjusting step may include, for example, measuring the engineering dimension between the first nozzle 210 and the second nozzle 212, and may further include altering one or both of the first nozzle assembly 200 or the second nozzle assembly 202 if required such that the engineering dimension is within the predetermined engineering tolerance for that engineering dimension. FIG. 4, provides, for illustrative purposes only, a view of the airfoils 110 of nozzles 210, 212 positioned for measuring an engineering dimension, in this case dimension 240.

In some embodiments, the adjusting step may occur after the assembling steps, and before a joining step as discussed herein. In other embodiments, the adjusting step may occur during the assembling steps, such as after the inserting steps discussed above with reference to FIG. 6 but before the connecting steps as discussed above with reference to FIGS. 7 through 9. To alter the nozzle assemblies 200, 202 after measuring the engineering dimension, the inner hangers 150 and/or outer hanger 160 of the nozzle support structures 220, 222 may, for example, be altered such that the engineering dimension is within the predetermined tolerances. For example, the slash faces 154, 155, 164, 165 may be trimmed or re-positioned relative to each other such that the engineering dimension is within the predetermined tolerances.

A method in accordance with the present disclosure may further include, for example, the step of joining the first nozzle support structure 220 and the second nozzle support structure 222 together. For example, the joining step may include joining the inner hangers 150 of the first nozzle support structure 220 and second nozzle support structure 222 together and joining the outer hangers 160 of the first nozzle support structure 220 and second nozzle support structure 222 together. In particular, and as shown for example in FIGS. 5 and 6, the suction side slash face 155 of the inner hanger 150 of the first nozzle support structure 220 and the pressure side slash face 154 of the inner hanger 150 of the second nozzle support structure 222 may be joined together, and the suction side slash face 165 of the outer hanger 160 of the first nozzle support structure 220 and the pressure side slash face 164 of the outer hanger 160 of the second nozzle support structure 222 may be joined together.

Figure 5:
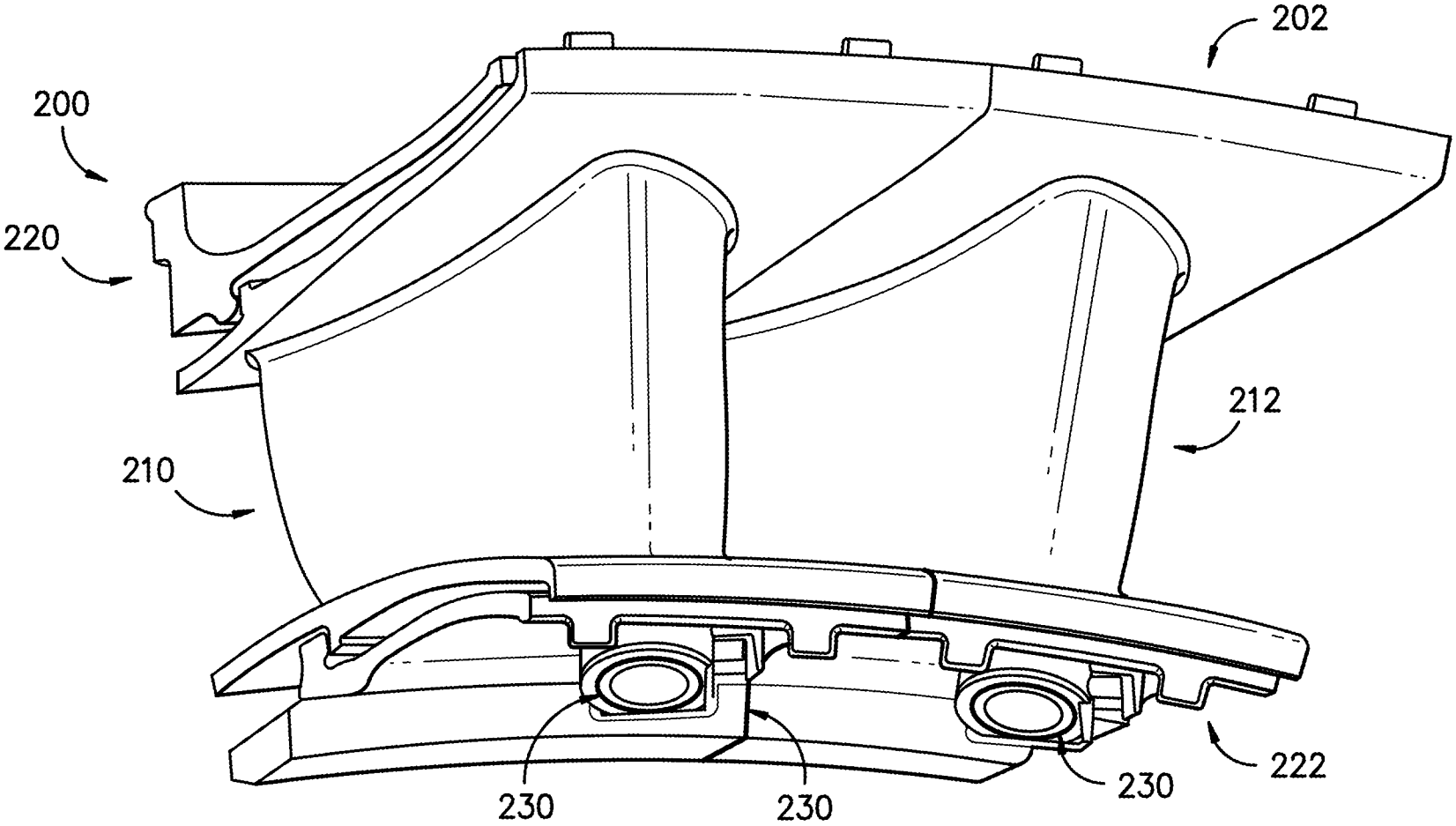
FIG. 5 is a perspective view of joined neighboring nozzle assemblies in accordance with one embodiment of the present disclosure.

As discussed above, such joining step may occur before or after the assembling steps discussed herein. For example, in some embodiments, as illustrated in FIG. 5, the joining step may occur after the assembling steps as well as the adjusting step. FIG. 5 illustrates the joints 230 resulting from joining of the nozzle support structures 220, 222. Such joining in these embodiments generally couples the nozzle assemblies 200, 202 together such that the possibility of further adjustments in the engineering dimension are advantageously reduced or eliminated.

In other embodiments, as illustrated in FIG. 6, the joining step may occur before the assembling steps. As shown, the inner hangers 150 and outer hangers 160 are joined together before assembling the nozzle assemblies 200, 202. In these embodiments, after the joining step, connecting of the struts 140 of the nozzle support structures 220, 222 to the respective inner hangers 150 and/or outer hangers 160 generally couples the nozzle assemblies 200, 202 together such that the possibility of further adjustments in the engineering dimension are advantageously reduced or eliminated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for positioning neighboring nozzles of a gas turbine engine, the method comprising:

assembling a first nozzle assembly, the first nozzle assembly comprising a first nozzle and a first nozzle support structure, the first nozzle comprising an airfoil, an outer band disposed radially outward of the airfoil, and an inner band disposed radially inward of the airfoil, the first nozzle support structure comprising a strut extending through the nozzle, an outer hanger disposed radially outward of the airfoil, and an inner hanger disposed radially inward of the airfoil;

assembling a second nozzle assembly, the second nozzle assembly comprising a second nozzle and a second nozzle support structure, the second nozzle comprising an airfoil, an outer band disposed radially outward of the airfoil, and an inner band disposed radially inward of the airfoil, the second nozzle support structure comprising a strut extending through the nozzle, an outer hanger disposed radially outward of the airfoil, and an inner hanger disposed radially inward of the airfoil;

adjusting the first nozzle assembly and the second nozzle assembly such that an engineering dimension between the first nozzle and the second nozzle is within plus or minus 4% of the desired engineering dimension wherein the engineering dimension is a dimension between a trailing edge of the airfoil of the first nozzle and a high camber location on a suction side of the airfoil of the second nozzle; and joining the first nozzle support structure and the second nozzle support structure together by brazing the first nozzle support structure and the second nozzle support structure together by joining the inner hangers of the first nozzle support structure and the second nozzle support structure together by joining a suction side slash face of the inner hanger of the first nozzle support structure and a pressure side slash face of the inner hanger of the second nozzle support structure together; and by joining the outer hangers of the first nozzle support structure and the second nozzle support structure together by joining a suction side slash face of the outer hanger of the first nozzle support structure and a pressure side slash face of the outer hanger of the second nozzle support structure together.

2. The method of claim 1, wherein the steps of assembling the first nozzle assembly and assembling the second nozzle assembly are performed before the adjusting step and the joining step.

3. The method of claim 1, wherein the step of assembling the first nozzle assembly comprises:

inserting the strut of the first nozzle support structure through the first nozzle; and joining the strut of the first nozzle support structure to one of the inner hanger of the first nozzle support structure or the outer hanger of the first nozzle support structure.

4. The method of claim 3, wherein the strut is joined to the inner hanger of the first nozzle support structure.

5. The method of claim 1, wherein the joining step is performed before the steps of assembling the first nozzle assembly and assembling the second nozzle assembly.

6. The method of claim 1, wherein the step of assembling the first nozzle assembly comprises:

inserting the strut of the first nozzle support structure through the first nozzle; and connecting the strut of the first nozzle support structure to one of the inner hanger of the first nozzle support structure or the outer hanger of the first nozzle support structure.

7. The method of claim 1, wherein the first nozzle and the second nozzle are formed from ceramic matrix composite materials.

8. The method of claim 1, wherein the first nozzle support structure and the second nozzle support structure are formed from metals.

9. A method for positioning neighboring nozzles of a gas turbine engine, the method comprising:

joining an inner hanger of a first nozzle support structure and an inner hanger of a second nozzle support structure together; and joining an outer hanger of the first nozzle support structure and an outer hanger of the second nozzle support structure together;

after joining the inner hangers and outer hangers together, assembling a first nozzle assembly by inserting the strut of the first nozzle support structure through the first nozzle; and connecting the strut of the first nozzle support structure to one of the inner hanger of the first nozzle support structure or the outer hanger of the first nozzle support structure, the first nozzle assembly comprising a first nozzle and the first nozzle support structure, the first nozzle comprising an airfoil, an outer band disposed radially outward of the airfoil, and an inner band disposed radially inward of the airfoil, the first nozzle support structure comprising a strut extending through the nozzle, the outer hanger disposed radially outward of the airfoil, and the inner hanger disposed radially inward of the airfoil;

after joining the inner hangers by brazing the inner hangers together and outer hangers together by brazing the outer hangers together, assembling a second nozzle assembly, the second nozzle assembly comprising a second nozzle and the second nozzle support structure, the second nozzle comprising an airfoil, an outer band disposed radially outward of the airfoil, and an inner band disposed radially inward of the airfoil, the second nozzle support structure comprising a strut extending through the nozzle, the outer hanger disposed radially outward of the airfoil, and the inner hanger disposed radially inward of the airfoil; and adjusting the first nozzle assembly and the second nozzle assembly such that an engineering dimension between the first nozzle and the second nozzle is within plus or minus 4% of the desired engineering dimension.

* * * * *